US012420899B2

(12) United States Patent
Ikegaya

(10) Patent No.: US 12,420,899 B2
(45) Date of Patent: Sep. 23, 2025

(54) MARINE PROPULSION SYSTEM AND MARINE VESSEL

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 567 days.

(21) Appl. No.: 18/072,766

(22) Filed: Dec. 1, 2022

(65) Prior Publication Data

US 2023/0202630 A1 Jun. 29, 2023

(30) Foreign Application Priority Data

Dec. 24, 2021 (JP) ..... 2021-211242

(51) Int. Cl.
*B63H 20/10* (2006.01)
*B63H 20/00* (2006.01)
*B63H 20/02* (2006.01)

(52) U.S. Cl.
CPC ..... *B63H 20/10* (2013.01); *B63H 20/02* (2013.01); *B63H 2020/003* (2013.01)

(58) Field of Classification Search
CPC ... B63H 20/10; B63H 20/02; B63H 2020/003
See application file for complete search history.

(56) References Cited

U.S. PATENT DOCUMENTS

2006/0234566 A1 10/2006 Ando
2008/0176463 A1 7/2008 Salmon
2015/0089434 A1* 3/2015 Akuzawa ..... G06F 3/04886 715/773
2018/0134354 A1 5/2018 Suzuki et al.
2021/0139123 A1 5/2021 Osara et al.

FOREIGN PATENT DOCUMENTS

| | | | | |
|---|---|---|---|---|
| CA | 2741385 | A1 * | 11/2011 | ..... B63H 20/14 |
| EP | 0778196 | A1 | 6/1997 | |
| EP | 3569493 | A1 | 11/2019 | |
| JP | 8-72788 | A | 3/1996 | |
| JP | 2006-291927 | | 10/2006 | |
| JP | 2018-79744 | | 5/2018 | |
| JP | 2019-199148 | | 11/2019 | |

OTHER PUBLICATIONS

Extended European Search Report in EP22209852.7, mailed May 30, 2023, 10 pages.

* cited by examiner

*Primary Examiner* — Stephen P Avila
(74) *Attorney, Agent, or Firm* — Keating & Bennett, LLP

(57) ABSTRACT

A marine propulsion system includes a main propulsion device including a main thruster, an auxiliary propulsion device to be attached to a stern on one side of a centerline of a hull in a right-left direction and including an auxiliary thruster, and a remote control lever to switch between a neutral state, a forward movement state, and a reverse movement state. The auxiliary propulsion device further includes a tilt device to tilt up and tilt down an auxiliary propulsion device body, and is operable to tilt up the auxiliary propulsion device body with the tilt device when the main propulsion device is switched from the neutral state to the forward movement state by the remote control lever while the auxiliary propulsion device body is tilted down.

20 Claims, 3 Drawing Sheets

MARINE PROPULSION SYSTEM AND MARINE VESSEL

CROSS REFERENCE TO RELATED APPLICATIONS

This application claims the benefit of priority to Japanese Patent Application No. 2021-211242 filed on Dec. 24, 2021. The entire contents of this application are hereby incorporated herein by reference.

BACKGROUND OF THE INVENTION

1. Field of the Invention

The present invention relates to a marine propulsion system and a marine vessel.

2. Description of the Related Art

A marine propulsion system and a marine vessel each including a main propulsion device attached to a stern of a hull on a centerline of the hull in a right-left direction, and an auxiliary propulsion device attached to the stern of the hull on one side of the centerline of the hull in the right-left direction are known in general. Such a marine propulsion system and a marine vessel are disclosed in Japanese Patent Laid-Open No. 8-072788, for example.

Japanese Patent Laid-Open No. 8-072788 discloses a marine vessel including a main propulsion device and an auxiliary propulsion device. The main propulsion device is attached to a stern on a centerline extending in a forward-rearward direction through the center of a hull in a right-left direction. The auxiliary propulsion device is attached to the stern of the hull on one side of the centerline of the hull in the right-left direction. Furthermore, the auxiliary propulsion device is rotatable about a tilt shaft such that a screw is located above the water surface.

In Japanese Patent Laid-Open No. 8-072788, the auxiliary propulsion device is provided to one side of the centerline of the hull in the right-left direction, and thus when the main propulsion device propels the marine vessel while the screw of the auxiliary propulsion device is located in the water, a resistance acts on one side of the centerline of the hull in the right-left direction, and the direction maintenance performance of the hull is decreased. Therefore, it is conceivable to place the screw of the auxiliary propulsion device above the water surface in advance when the main propulsion device propels the marine vessel. In such a case, it is necessary for a user to perform a predetermined operation in order to place the screw above the water surface. Therefore, it has been conventionally required to improve the operability when the main propulsion device propels the marine vessel.

SUMMARY OF THE INVENTION

Preferred embodiments of the present invention provide marine propulsion systems and marine vessels that each reduce or prevent a decrease in direction maintenance performance of hulls due to auxiliary propulsion devices attached to sterns on one side of centerlines of the hulls in a right-left direction when main propulsion devices propel the hulls, and improve operability when the main propulsion devices propel the hulls.

A marine propulsion system according to a preferred embodiment of the present invention includes a main propulsion device to be attached to a stern of a hull on a centerline of the hull in a right-left direction and including a main thruster to generate a thrust, an auxiliary propulsion device to be attached to the stern on one side of the centerline of the hull in the right-left direction, including an auxiliary thruster to generate a thrust, and having a maximum output smaller than a maximum output of the main propulsion device, and a remote control lever to switch between a neutral state in which the main thruster is stopped, a forward movement state in which the main thruster generates a forward thrust, and a reverse movement state in which the main thruster generates a reverse thrust. The auxiliary propulsion device further includes a tilt device to tilt up and tilt down an auxiliary propulsion device body, and is operable to tilt up the auxiliary propulsion device body with the tilt device when the main propulsion device is switched from the neutral state to the forward movement state by the remote control lever while the auxiliary propulsion device body is tilted down.

In a marine propulsion system according to a preferred embodiment of the present invention, the auxiliary propulsion device to be attached to the stern on one side of the centerline of the hull in the right-left direction is operable to tilt up the auxiliary propulsion device body when the main propulsion device is switched from the neutral state to the forward movement state by the remote control lever while the auxiliary propulsion device body is tilted down. Accordingly, the auxiliary propulsion device body is tilted up when the main propulsion device moves the hull forward, and thus the action of a resistance on one side of the centerline of the hull in the right-left direction is reduced or prevented. Furthermore, an operation on the remote control lever is used as a trigger to automatically tilt up the auxiliary propulsion device body, and thus it is not necessary to perform a dedicated operation to tilt up the auxiliary propulsion device body. Therefore, a decrease in the direction maintenance performance of the hull due to the auxiliary propulsion device attached to the stern on one side of the centerline of the hull in the right-left direction is reduced or prevented when the main propulsion device moves the hull forward, and the operability is improved when the main propulsion device moves the hull forward.

A marine propulsion system according to a preferred embodiment of the present invention further includes a joystick to receive an operation to move the hull, a joystick mode operator to receive an operation to switch between an on-state and an off-state of a joystick mode in which the joystick receives the operation to move the hull, and a controller provided in the hull and configured or programmed to perform a control to tilt up the auxiliary propulsion device body based on the joystick mode being switched from the on-state to the off-state by the joystick mode operator while the auxiliary propulsion device body is tilted down. Accordingly, switching of the joystick mode from the on-state to the off-state is used as a trigger to automatically tilt up the auxiliary propulsion device body, and thus when the main propulsion device propels the hull thereafter, the main propulsion device starts to propel the hull while the auxiliary propulsion device body is tilted up. That is, the auxiliary propulsion device body is already tilted up when the remote control lever is operated, and thus the main propulsion device more smoothly starts to propel the hull.

In such a case, the controller is preferably configured or programmed to perform a control to tilt down the auxiliary propulsion device body based on the joystick mode being switched from the off-state to the on-state by the joystick mode operator. Accordingly, switching of the joystick mode from the off-state to the on-state by the joystick mode operator is used as a trigger to automatically tilt down the auxiliary propulsion device body, and thus it is not necessary to perform a dedicated operation to tilt down the auxiliary propulsion device body. Therefore, the operability at the start of the joystick mode in which the auxiliary propulsion device is also used is improved.

A marine propulsion system including the controller configured or programmed to perform a control to tilt up the auxiliary propulsion device body based on the joystick mode being switched from the on-state to the off-state preferably further includes an automatic operation mode operator to receive an operation to switch between an on-state and an off-state of a predetermined automatic operation mode in which the main propulsion device and the auxiliary propulsion device are automatically driven to move the hull or maintain a position of the hull, and the controller is preferably configured or programmed to perform a control to tilt up the auxiliary propulsion device body based on the predetermined automatic operation mode being switched from the on-state to the off-state by the automatic operation mode operator while the auxiliary propulsion device body is tilted down. Accordingly, switching of the predetermined automatic operation mode from the on-state to the off-state is used as a trigger to automatically tilt up the auxiliary propulsion device body, and thus when the main propulsion device propels the hull thereafter, the main propulsion device starts to propel the hull while the auxiliary propulsion device body is tilted up. That is, the auxiliary propulsion device body is already tilted up when the remote control lever is operated, and thus the main propulsion device more smoothly starts to propel the hull.

In such a case, the controller is preferably configured or programmed to perform a control to tilt down the auxiliary propulsion device body based on the predetermined automatic operation mode being switched from the off-state to the on-state by the automatic operation mode operator. Accordingly, switching of the predetermined automatic operation mode from the off-state to the on-state by the automatic operation mode operator is used as a trigger to automatically tilt down the auxiliary propulsion device body, and thus it is not necessary to perform a dedicated operation to tilt down the auxiliary propulsion device body. Therefore, the operability at the start of the automatic operation mode in which the auxiliary propulsion device is also used is improved.

In a marine propulsion system including the controller configured or programmed to perform a control to tilt down the auxiliary propulsion device body, the main propulsion device and the auxiliary propulsion device are preferably operable to not drive the main thruster and the auxiliary thruster during a tilt-down operation of the auxiliary propulsion device body. Accordingly, driving the main thruster and the auxiliary thruster during the tilt-down operation to generate a thrust in a direction different from a desired direction is reduced or prevented.

A marine propulsion system including the controller configured or programmed to perform a control to tilt down the auxiliary propulsion device body preferably further includes an angle setting operator to receive an operation to set a tilt angle of the auxiliary propulsion device body at a time of completion of tilting down of the auxiliary propulsion device body. Accordingly, the auxiliary propulsion device body is automatically located at the set angle at the time of completion of tilting down, and thus a user does not need to adjust the angle for each tilting down, and the operability is further improved when the main propulsion device propels the hull.

In a marine propulsion system including the controller configured or programmed to perform a control to tilt up the auxiliary propulsion device body based on the joystick mode being switched from the on-state to the off-state, the controller is preferably configured or programmed to maintain a tilted-up state of the auxiliary propulsion device body when the neutral state is switched to the forward movement state by the remote control lever while the auxiliary propulsion device body is tilted up. Accordingly, when the neutral state is switched to the forward movement state by the remote control lever, the state is maintained when the auxiliary propulsion device body is already tilted up.

In a marine propulsion system according to a preferred embodiment of the present invention, the auxiliary propulsion device is preferably operable to tilt up the auxiliary propulsion device body when the neutral state is switched to the reverse movement state by the remote control lever while the auxiliary propulsion device body is tilted down. Accordingly, a decrease in the direction maintenance performance of the hull due to the auxiliary propulsion device attached to the stern on one side of the centerline of the hull in the right-left direction is reduced or prevented not only when the main propulsion device moves the hull forward but also when the main propulsion device moves the hull rearward. In addition, the operability is improved when the main propulsion device moves the hull rearward.

A marine propulsion system according to a preferred embodiment of the present invention preferably further includes a tilt switching operator to receive an operation to switch between an automatic tilt-up mode in which the auxiliary propulsion device body is tilted up when the neutral state is switched to the forward movement state by the remote control lever and a tilt-up inoperative mode in which, when the neutral state is switched to the forward movement state by the remote control lever, the auxiliary propulsion device body is not tilted up and a tilted-down state of the auxiliary propulsion device is maintained. Accordingly, in consideration of a case in which the user does not want the tilting up to be performed automatically, for example, the tilt switching operator is used to switch between the automatic tilt-up mode and the tilt-up inoperative mode.

A marine propulsion system according to a preferred embodiment of the present invention preferably further includes a tilt stop operator to receive an operation to stop tilting up and tilting down of the auxiliary propulsion device body during tilt-up and tilt-down operations. Accordingly, during the tilt-up and tilt-down operations that are automatically performed, the tilting up and the tilting down are stopped by the user as desired depending on the situation.

A marine propulsion system according to a preferred embodiment of the present invention preferably further includes a notifier to notify a user that at least a tilt-up operation of the auxiliary propulsion device body is in progress when the neutral state is switched to the forward movement state by the remote control lever. Accordingly, the notifier makes the user aware of tilting up when the tilting up is performed unintentionally. Furthermore, the user is made aware that the auxiliary propulsion device body is in operation.

In a marine propulsion system according to a preferred embodiment of the present invention, the main propulsion device is preferably an engine outboard motor including an engine to drive a main propeller corresponding to the main thruster, and the auxiliary propulsion device is preferably an electric outboard motor including an electric motor to drive an auxiliary propeller corresponding to the auxiliary thruster. Accordingly, environmental burdens such as carbon dioxide emission associated with driving of the engine outboard motor are reduced. Furthermore, a decrease in the direction maintenance performance of the hull including the engine outboard motor and the electric outboard motor is reduced or prevented when the main propulsion device propels the hull, and the operability is improved when the main propulsion device propels the hull.

A marine propulsion system according to a preferred embodiment of the present invention includes a main propulsion device to be attached to a stern of a hull on a centerline of the hull in a right-left direction and including a main thruster to generate a thrust, an auxiliary propulsion device to be attached to the stern on one side of the centerline of the hull in the right-left direction, including an auxiliary thruster to generate a thrust, and having a maximum output smaller than a maximum output of the main propulsion device, and a remote control lever to change magnitudes of thrusts of the main thruster and the auxiliary thruster. The auxiliary propulsion device further includes a tilt device to tilt up and tilt down an auxiliary propulsion device body, and is operable to tilt up the auxiliary propulsion device body with the tilt device when a low speed state in which the hull is propelled at less than a predetermined speed is switched to a high speed state in which the hull is propelled at the predetermined speed or higher by the remote control lever while the auxiliary propulsion device body is tilted down.

In a marine propulsion system according to a preferred embodiment of the present invention, the auxiliary propulsion device to be attached to the stern on one side of the centerline of the hull in the right-left direction is operable to tilt up the auxiliary propulsion device body when the low speed state in which the hull is propelled at less than the predetermined speed is switched to the high speed state in which the hull is propelled at the predetermined speed or higher by the remote control lever while the auxiliary propulsion device body is tilted down. Accordingly, the auxiliary propulsion device body is tilted up when the marine vessel speed is increased, and thus the action of a resistance on one side of the centerline of the hull in the right-left direction is reduced or prevented. Furthermore, an operation on the remote control lever is used as a trigger to automatically tilt up the auxiliary propulsion device body, and thus it is not necessary to perform a dedicated operation to tilt up the auxiliary propulsion device body. Therefore, a decrease in the direction maintenance performance of the hull due to the auxiliary propulsion device attached to the stern on one side of the centerline of the hull in the right-left direction is reduced or prevented when the marine vessel speed is increased (when the main propulsion device propels the hull), and the operability is improved when the marine vessel speed is increased (when the main propulsion device propels the hull).

A marine vessel according to a preferred embodiment of the present invention includes a hull, and a marine propulsion system provided on or in the hull. The marine propulsion system includes a main propulsion device to be attached to a stern of a hull on a centerline of the hull in a right-left direction and including a main thruster to generate a thrust, an auxiliary propulsion device to be attached to the stern on one side of the centerline of the hull in the right-left direction, including an auxiliary thruster to generate a thrust, and having a maximum output smaller than a maximum output of the main propulsion device, and a remote control lever to switch between a neutral state in which the main thruster is stopped, a forward movement state in which the main thruster generates a forward thrust, and a reverse movement state in which the main thruster generates a reverse thrust. The auxiliary propulsion device further includes a tilt device to tilt up and tilt down an auxiliary propulsion device body, and is operable to tilt up the auxiliary propulsion device body with the tilt device when the main propulsion device is switched from the neutral state to the forward movement state by the remote control lever while the auxiliary propulsion device body is tilted down.

In a marine vessel according to a preferred embodiment of the present invention, the auxiliary propulsion device to be attached to the stern on one side of the centerline of the hull in the right-left direction is operable to tilt up the auxiliary propulsion device body when the main propulsion device is switched from the neutral state to the forward movement state by the remote control lever while the auxiliary propulsion device body is tilted down. Accordingly, the auxiliary propulsion device body is tilted up when the main propulsion device moves the hull forward, and thus the action of a resistance on one side of the centerline of the hull in the right-left direction is reduced or prevented. Furthermore, an operation on the remote control lever is used as a trigger to automatically tilt up the auxiliary propulsion device body, and thus it is not necessary to perform a dedicated operation to tilt up the auxiliary propulsion device body. Therefore, a decrease in the direction maintenance performance of the hull due to the auxiliary propulsion device attached to the stern on one side of the centerline of the hull in the right-left direction is reduced or prevented when the main propulsion device moves the hull forward, and the operability is improved when the main propulsion device moves the hull forward.

In a marine vessel according to a preferred embodiment of the present invention, the marine propulsion system preferably further includes a joystick to receive an operation to move the hull, a joystick mode operator to receive an operation to switch between an on-state and an off-state of a joystick mode in which the joystick receives the operation to move the hull, and a controller provided in the hull and configured or programmed to perform a control to tilt up the auxiliary propulsion device body based on the joystick mode being switched from the on-state to the off-state by the joystick mode operator while the auxiliary propulsion device body is tilted down. Accordingly, switching of the joystick mode from the on-state to the off-state is used as a trigger to automatically tilt up the auxiliary propulsion device body, and thus when the main propulsion device propels the hull thereafter, the main propulsion device starts to propel the hull while the auxiliary propulsion device body is tilted up. That is, the auxiliary propulsion device body is already tilted up when the remote control lever is operated, and thus the main propulsion device more smoothly starts to propel the hull.

In such a case, the controller is preferably configured or programmed to perform a control to tilt down the auxiliary propulsion device body based on the joystick mode being switched from the off-state to the on-state by the joystick mode operator. Accordingly, switching of the joystick mode from the off-state to the on-state by the joystick mode operator is used as a trigger to automatically tilt down the auxiliary propulsion device body, and thus it is not necessary to perform a dedicated operation to tilt down the auxiliary propulsion device body. Therefore, the operability at the start of the joystick mode in which the auxiliary propulsion device also used is improved.

In a marine vessel including the controller configured or programmed to perform a control to tilt up the auxiliary propulsion device body based on the joystick mode being switched from the on-state to the off-state, the marine propulsion system preferably further includes an automatic operation mode operator to receive an operation to switch between an on-state and an off-state of a predetermined automatic operation mode in which the main propulsion device and the auxiliary propulsion device are automatically driven to move the hull or maintain a position of the hull, and the controller is preferably configured or programmed to perform a control to tilt up the auxiliary propulsion device body based on the predetermined automatic operation mode being switched from the on-state to the off-state by the automatic operation mode operator while the auxiliary propulsion device body is tilted down. Accordingly, switching of the predetermined automatic operation mode from the on-state to the off-state is used as a trigger to automatically tilt up the auxiliary propulsion device body, and thus when the main propulsion device propels the hull thereafter, the main propulsion device starts to propel the hull while the auxiliary propulsion device body is tilted up. That is, the auxiliary propulsion device body is already tilted up when the remote control lever is operated, and thus the main propulsion device more smoothly starts to propel the hull.

In such a case, the controller is preferably configured or programmed to perform a control to tilt down the auxiliary propulsion device body based on the predetermined automatic operation mode being switched from the off-state to the on-state by the automatic operation mode operator. Accordingly, switching of the predetermined automatic operation mode from the off-state to the on-state by the automatic operation mode operator is used as a trigger to automatically tilt down the auxiliary propulsion device body, and thus it is not necessary to perform a dedicated operation to tilt down the auxiliary propulsion device body. Therefore, the operability at the start of the automatic operation mode in which the auxiliary propulsion device is also used is improved.

In a marine vessel including the controller configured or programmed to perform a control to tilt down the auxiliary propulsion device body, the main propulsion device and the auxiliary propulsion device are preferably operable to not drive the main thruster and the auxiliary thruster during a tilt-down operation of the auxiliary propulsion device body. Accordingly, driving the main thruster and the auxiliary thruster during the tilt-down operation to generate a thrust in a direction different from a desired direction is reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including a marine propulsion system 102 according to preferred embodiments of the present invention is now described with reference to FIGS. 1 to 7.

In the figures, arrow FWD represents the forward movement direction of the marine vessel 100 in a forward-rearward direction, and arrow BWD represents the reverse movement direction of the marine vessel 100 in the forward-rearward direction. Arrow R represents the starboard direction of the marine vessel 100 in a right-left direction (a direction perpendicular to the forward-rearward direction), and arrow L represents the portside direction of the marine vessel 100 in the right-left direction.

Figure 1:
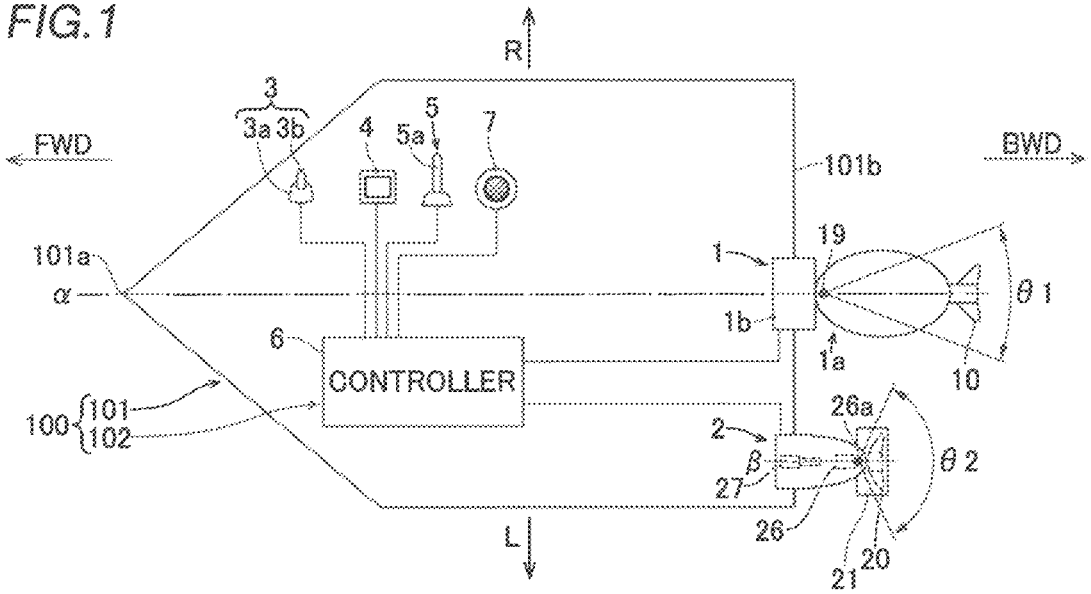
FIG. 1 is a schematic view showing a marine vessel including a marine propulsion system and a hull according to a preferred embodiment of the present invention.

As shown in FIG. 1, the marine vessel 100 includes a hull 101 and the marine propulsion system 102 provided on or in the hull 101. The hull 101 may be a hull of a fishing boat or a fishing vessel for a user to fish, or a relatively large hull such as a passenger vessel, for example.

The marine propulsion system 102 includes a main propulsion device 1, an auxiliary propulsion device 2, a joystick 3, a touch-screen display 4 that displays navigation-related information, etc., a remote control lever 5, a controller 6, and a notifier 7. The joystick 3, the touch-screen display 4, the remote control lever 5, the controller 6, and the notifier 7 are provided on or in the hull 101.

The marine propulsion system 102 is switchable between an automatic tilt-up mode and a tilt-up inoperative mode.

In the automatic tilt-up mode, an auxiliary propulsion device body 2*a* is tilted up when the main propulsion device 1 is switched from a neutral state to a forward movement state by the remote control lever 5. In the automatic tilt-up mode, the auxiliary propulsion device body 2*a* is tilted up also when the main propulsion device 1 is switched from the neutral state to a reverse movement state by the remote control lever 5. In the automatic tilt-up mode, the auxiliary propulsion device body 2*a* is automatically tilted down when a predetermined marine vessel maneuvering mode such as a joystick mode is switched from an on-state to an off-state. In the automatic tilt-up mode, the auxiliary propulsion device body 2*a* is automatically tilted up when the predetermined marine vessel maneuvering mode such as the joystick mode is switched from the off-state to the on-state.

That is, in the automatic tilt-up mode, the auxiliary propulsion device body 2*a* is automatically tilted up and down in conjunction with other predetermined operations even when the user does not perform dedicated operations only to tilt up and tilt down the auxiliary propulsion device body 2*a*.

In the tilt-up inoperative mode, when the user performs dedicated operations only to tilt up and tilt down the auxiliary propulsion device body 2*a*, the auxiliary propulsion device body 2*a* is tilted up and tilted down. In the tilt-up inoperative mode, when the main propulsion device 1 is switched from the neutral state to either the forward movement state or the reverse movement state by the remote control lever 5, the auxiliary propulsion device body 2*a* is not automatically tilted up, and the tilted-down state of the auxiliary propulsion device 2 is maintained.

In the joystick mode, the joystick 3 is able to receive an operation to move the hull 101. The expression "switching the joystick mode from the on-state to the off-state" indicates switching from a state in which the joystick 3 is used to maneuver the marine vessel to a state in which the remote control lever 5 is used to maneuver the marine vessel.

Figure 2:
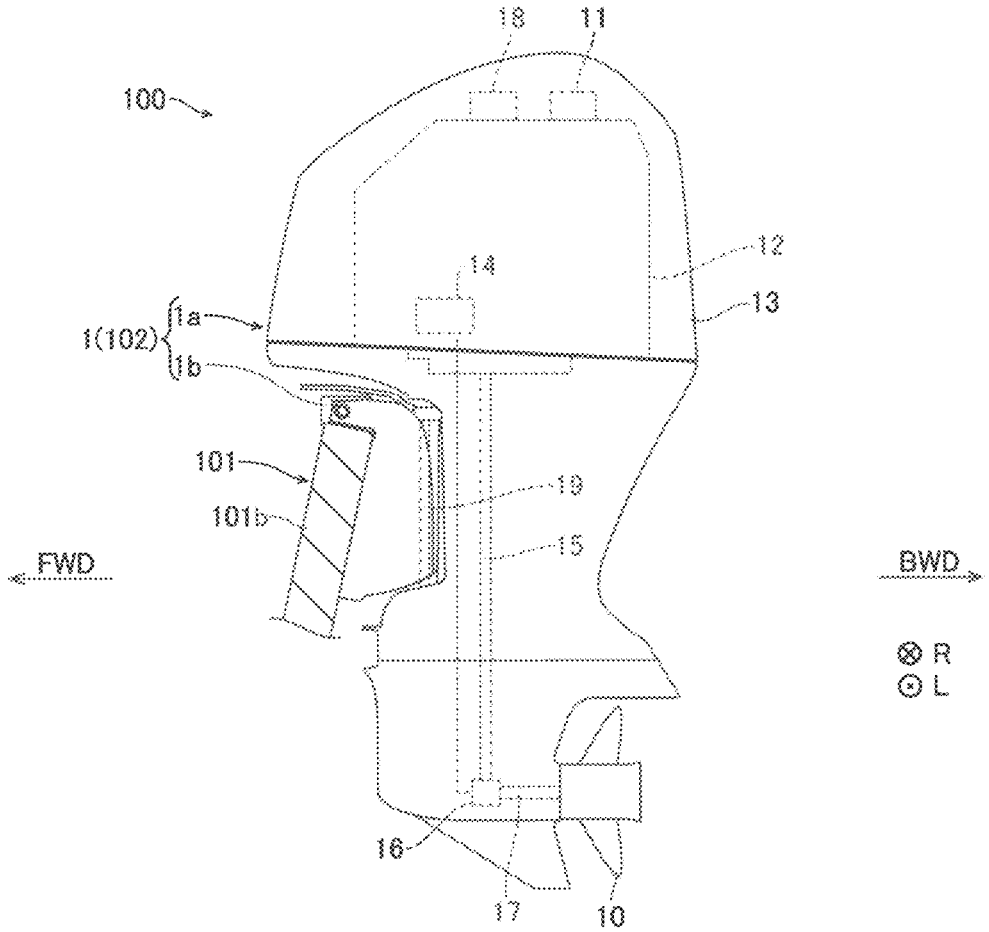
FIG. 2 is a side view showing a main propulsion device of a marine propulsion system according to a preferred embodiment of the present invention.
Figure 4:
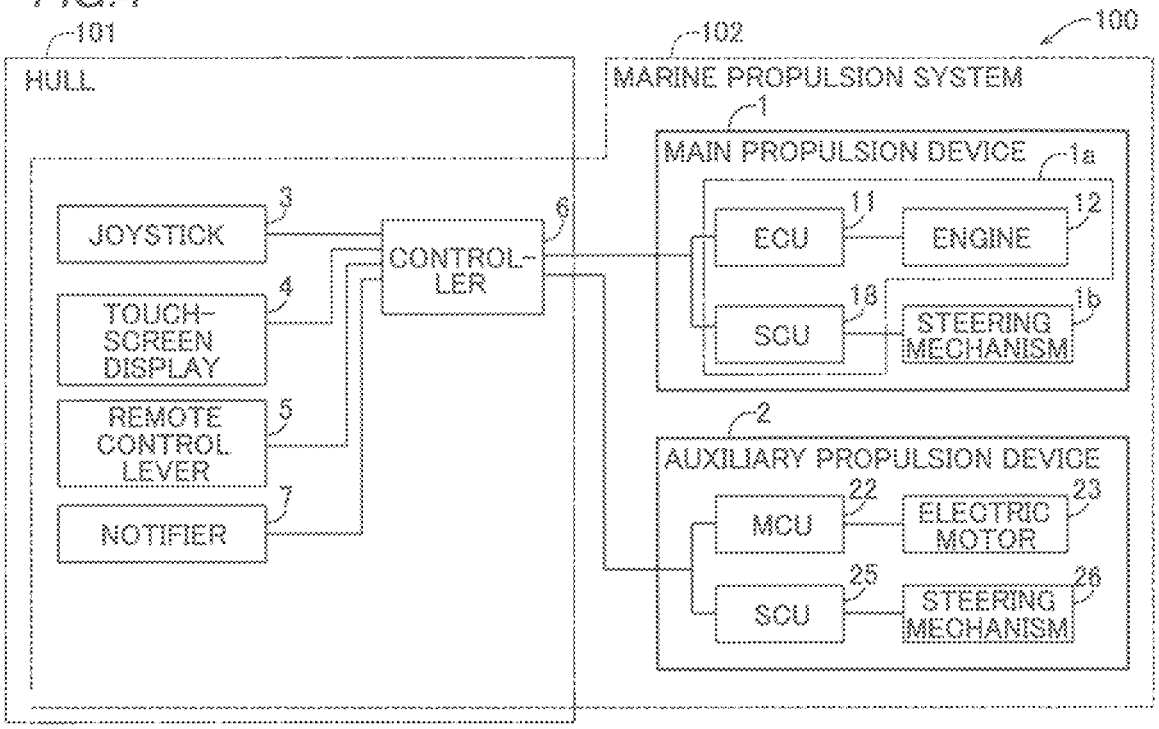
FIG. 4 is a block diagram of a marine vessel including a marine propulsion system and a hull according to a preferred embodiment of the present invention.

Only one main propulsion device 1 shown in FIGS. 2 and 4 is attached to a stern 101*b* (transom) of the hull 101. The main propulsion device 1 is an engine outboard motor including an engine 12 to drive a main propeller 10 to generate a thrust. The main propulsion device 1 is provided on a centerline a of the hull 101 in the right-left direction. The main propulsion device 1 rotates in the right-left direction to change the direction of the thrust of the main propeller 10. The main propeller 10 is an example of a "main thruster".

The main propulsion device 1 includes a main propulsion device body 1*a* and a steering mechanism 1*b* provided on the main propulsion device body 1*a*. The main propulsion device body 1*a* is attached to the stern 101*b* of the hull 101 via the steering mechanism 1*b*.

The main propulsion device body 1*a* includes the main propeller 10, an engine control unit (ECU) 11, the engine 12, a cowling 13, a shift actuator 14, a drive shaft 15, a gearing 16, a propeller shaft 17, and a steering control unit (SCU) 18.

The ECU 11 is a control circuit, for example, and includes a central processing unit (CPU). The ECU 11 controls driving of the engine 12 based on a command from the controller 6.

The engine 12 is a drive source for the main propeller 10. The engine 12 is provided in an upper portion of the main propulsion device 1, and is an internal combustion engine driven by explosive combustion of gasoline, light oil, or the like. The engine 12 is covered with the cowling 13. As an example, the maximum output of the engine 12 is about 200 horsepower.

The shift actuator 14 switches the shift state of the main propulsion device 1 to any one of a forward movement state (shift F), a reverse movement state (shift R), and a neutral state (shift N) by switching the meshing of the gearing 16 based on an operation on the remote control lever 5. When the shift state of the main propulsion device 1 is in the forward movement state, a thrust is generated from the main propeller 10 toward the FWD side, and when the shift state is in the reverse movement state, a thrust is generated from the main propeller 10 toward the BWD side. When the shift state is in the neutral state, a thrust is not generated from the main propeller 10.

The drive shaft 15 is connected to a crankshaft (not shown) of the engine 12 so as to transmit a power from the engine 12. The gearing 16 transmits a rotational force from the drive shaft 15 to the propeller shaft 17. The main propeller 10 is attached to a rear end of the propeller shaft 17. The main propeller 10 generates a thrust in the axial direction of the propeller shaft 17 by rotating in the water. The main propeller 10 moves the hull 101 forward or rearward by switching the direction of the thrust between a forward direction and a rearward direction according to the rotational direction switched depending on the shift state.

The SCU 18 is a control circuit, for example, and includes a central processing unit (CPU). The SCU 18 controls driving of the steering mechanism 1*b* based on a command from the controller 6.

The steering mechanism 1*b* rotates the main propulsion device body 1*a* in the right-left direction with a steering shaft 19 extending in an upward-downward direction as a central axis of rotation. That is, the steering mechanism 1*b* changes the orientation of the main propulsion device body 1*a* in the right-left direction. When the orientation of the main propulsion device body 1*a* in the right-left direction changes, the direction of the thrust of the main propeller 10 also changes according to the orientation of the main propulsion device body 1*a*.

As an example, a right-left rotatable angle range θ1 (see FIG. 1) to change the direction of the thrust of the main propulsion device 1 is about 60 degrees (30 degrees on one side). As an example, the steering mechanism 1*b* includes a hydraulic cylinder (not shown) to apply a rotational force to the steering shaft 19, and an oil pump to adjust the amount of hydraulic oil in the hydraulic cylinder.

Figure 3:
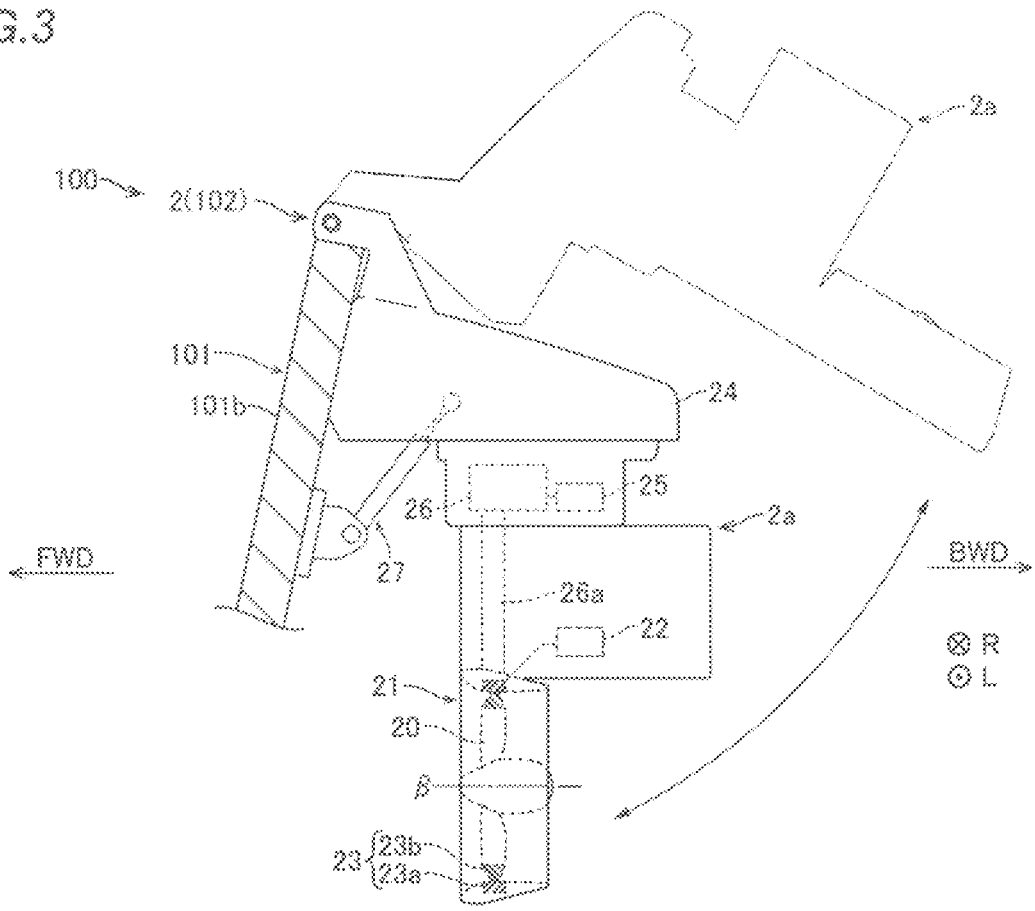
FIG. 3 is a side view showing an auxiliary propulsion device of a marine propulsion system according to a preferred embodiment of the present invention.

Only one auxiliary propulsion device 2 shown in FIGS. 3 and 4 is attached to the stern 101*b* (transom) of the hull 101. The auxiliary propulsion device 2 is an electric outboard motor including an electric motor 23 to drive an auxiliary propeller 20 to generate a thrust. The auxiliary propulsion device 2 is provided to one side of the centerline of the hull 101 in the right-left direction. Specifically, the auxiliary propulsion device 2 is located on the left side relative to the centerline a (see FIG. 1) of the hull 101 in the right-left direction. The auxiliary propulsion device 2 rotates in the right-left direction to change the direction of the thrust of the auxiliary propeller 20. The auxiliary propeller 20 is an example of an "auxiliary thruster".

The auxiliary propulsion device 2 includes the auxiliary propeller 20, a duct 21, a motor control unit (MCU) 22, the electric motor 23, a cowling 24, a steering control unit (SCU) 25, a steering mechanism 26, and a tilt device 27.

The duct 21 is provided in a lower portion of the auxiliary propulsion device 2 with the auxiliary propeller 20 located in the water. The duct 21 has a cylindrical shape and supports the auxiliary propeller 20 on the inner peripheral side such that the auxiliary propeller 20 is rotatable. In FIG. 3, the central position of rotation of the auxiliary propeller 20 is indicated by a central axis β. That is, the auxiliary propeller 20 generates a thrust in a direction along the central axis β.

The MCU 22 is a control circuit, for example, and includes a central processing unit (CPU). The MCU 22 controls driving of the electric motor 23 based on a command from the controller 6.

The electric motor 23 is a drive source for the auxiliary propeller 20. The electric motor 23 is driven by power from a battery (not shown) mounted on the hull 101, for example. The maximum output of the electric motor 23 of the auxiliary propulsion device 2 is smaller than the maximum output of the engine 12 of the main propulsion device 1. As an example, the maximum output of the electric motor 23 is about 20 horsepower.

The electric motor 23 includes a stator 23*a* integral and unitary with the duct 21 and a rotor 23*b* integral and unitary with the auxiliary propeller 20.

The cowling 24 covers an upper portion of the auxiliary propulsion device 2 such that electrical wiring and the like are not exposed. The cowling 24 does not rotate in the right-left direction unlike the auxiliary propeller 20 when the direction of the thrust in the right-left direction is changed. That is, the auxiliary propulsion device 2 does not rotate the entire auxiliary propulsion device 2 (auxiliary propulsion device body 2*a*) excluding the steering mechanism 26 in the right-left direction but rotates only a portion (such as the duct 21 and the auxiliary propeller 20) of the auxiliary propulsion device 2 on the lower side, unlike the main propulsion device 1 that rotates the entire main propulsion device body 1*a* excluding the steering mechanism 1*b* in the right-left direction.

Therefore, the auxiliary propulsion device 2 does not need to rotate a relatively large structure such as the engine 12 of the main propulsion device 1 in the right-left direction, and thus a right-left rotatable angle range θ2 (see FIG. 1) to change the direction of the thrust is relatively large. As an example, the right-left rotatable angle range θ2 to change the direction of the thrust of the auxiliary propulsion device 2 is about 140 degrees (70 degrees on one side).

The auxiliary propeller 20 generates a thrust by rotating in the water. The drive source for the auxiliary propeller 20 is the electric motor 23, and thus the auxiliary propeller 20 is able to freely switch between forward rotation, reverse rotation (the direction of the thrust in the forward-rearward direction), and stop without generating a shift shock unlike the main propulsion device 1.

The SCU 25 is a control circuit, for example, and includes a central processing unit (CPU). The SCU 25 controls driving of the steering mechanism 26 based on a command from the controller 6.

The steering mechanism 26 is built into the auxiliary propulsion device 2. The steering mechanism 26 rotates the duct 21 in the right-left direction with a steering shaft 26*a* extending in the upward-downward direction as a central axis of rotation. When the orientation of the duct 21 in the right-left direction changes, the direction of the thrust of the auxiliary propeller 20 supported by the duct 21 also changes.

As an example, the steering mechanism 26 includes a reduction gear unit (not shown) to apply a rotational force to the steering shaft 26*a*, an electric motor (not shown) to drive the reduction gear unit, etc.

The tilt device 27 tilts up and tilts down the auxiliary propulsion device body 2*a*. That is, the tilt device 27 switches between a state in which the auxiliary propeller 20 is located in the water and a state in which the auxiliary propeller 20 is located above the water surface. The tilt device 27 includes a hydraulic cylinder and an oil pump to adjust the amount of hydraulic oil in the hydraulic cylinder.

The auxiliary propulsion device 2 tilts up the auxiliary propulsion device body 2*a* with the tilt device 27 when the main propulsion device 1 is switched from the neutral state to the forward movement state by the remote control lever 5 while the auxiliary propulsion device body 2*a* is tilted down. The auxiliary propulsion device 2 tilts up the auxiliary propulsion device body 2*a* based on a command from the controller 6 when the main propulsion device 1 is switched to the forward movement state as described above.

The auxiliary propulsion device 2 tilts up the auxiliary propulsion device body 2*a* when the main propulsion device 1 is switched from the neutral state to the reverse movement state by the remote control lever 5 while the auxiliary propulsion device body 2*a* is tilted down. The auxiliary propulsion device 2 tilts up the auxiliary propulsion device body 2*a* based on a command from the controller 6 when the main propulsion device 1 is switched to the reverse movement state as described above.

The auxiliary propulsion device 2 does not drive the auxiliary propeller 20 during tilt-down operation of the auxiliary propulsion device body 2*a*. Similarly, the main propulsion device 1 does not drive the main propeller 10 during the tilt-down operation of the auxiliary propulsion device body 2*a*. On the other hand, the main propulsion device 1 is able to drive the main propeller 10 during the tilt-up operation of the auxiliary propulsion device body 2*a*.

Figure 5:
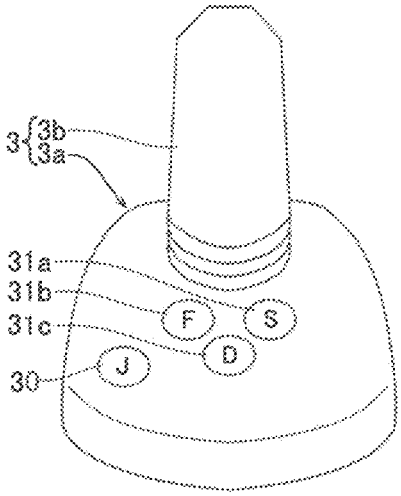
FIG. 5 is a diagram showing a joystick of a marine propulsion system according to a preferred embodiment of the present invention.

The joystick 3 shown in FIG. 5 is an operator to receive an operation to move the hull 101. The joystick 3 includes a main body 3*a* and a columnar stick 3*b* extending upward from the main body 3*a*. The stick 3*b* is a portion that is gripped by the user during maneuvering of the marine vessel.

The main body 3*a* includes a joystick button 30 to receive an operation to switch between the on-state and the off state of the joystick mode. The joystick button 30 is an example of a "joystick mode operator".

The joystick button 30 switches between a state in which the remote control lever 5 (see FIG. 1) is used to maneuver the marine vessel and a state (joystick mode) in which the joystick 3 is used to maneuver the marine vessel.

The main body 3*a* includes a STAYPOINT™ button 31*a* to receive an operation to switch the on-state and the off-state of a STAYPOINT™ (fixed point holding) mode, which is an automatic operation mode, a FISHPOINT™ button 31*b* to receive an operation to switch the on-state and the off-state of a FISHPOINT™ mode, which is an automatic operation mode, and a drift button 31*c* to receive an operation to switch the on-state and the off-state of a drift mode, which is an automatic operation mode. The STAYPOINT™ button 31*a*, the FISHPOINT™ button 31*b*, and the drift button 31*c* are examples of an "automatic operation mode operator".

The automatic operation mode refers to a mode in which the main propulsion device 1 and the auxiliary propulsion device 2 are automatically driven to move the hull 101 or maintain the position of the hull 101.

The STAYPOINT™ mode refers to an automatic operation mode to maintain the orientation of a bow 101*a* of the hull 101 at a target orientation and maintain the position of the hull 101 at a set target point.

The FISHPOINT™ mode refers to an automatic operation mode to direct the stern 101*b* (or the bow 101*a*) of the hull 101 to the set target point by rotating the hull 101 and maintain the hull 101, the stern 101*b* (or the bow 101*a*) of which has been directed to the target point, at the set target point by moving the hull 101 in the forward-rearward direction.

The drift mode refers to an automatic operation mode to move the hull 101 under external forces including wind and water flow while maintaining the orientation of the bow 101*a* of the hull 101 at the target orientation by rotating the hull 101.

Figure 6:
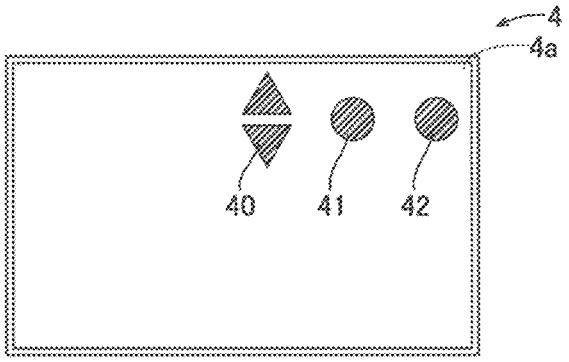
FIG. 6 is a diagram showing a touch-screen display of a marine propulsion system according to a preferred embodiment of the present invention.

As shown in FIG. 6, the touch-screen display 4 includes a touch panel 4*a* on which a touch operation is performed by the user. The touch-screen display 4 displays navigation-related information, various operation buttons, etc. on the touch panel 4*a*.

For example, the touch-screen display 4 displays an angle setting button 40 on the touch panel 4*a*. The angle setting button 40 receives an operation to set the tilt angle of the auxiliary propulsion device body 2*a* at the time of completion of tilting down of the auxiliary propulsion device body 2*a*. The angle setting button 40 includes an angle up button and an angle down button, and is used to set the tilt angle of the auxiliary propulsion device body 2*a* at the completion of tilting down. The angle setting button 40 is an example of an "angle setting operator".

The touch-screen display 4 displays a tilt switching button 41 on the touch panel 4*a*. The tilt switching button 41 receives an operation to switch between the automatic tilt-up mode and the tilt-up inoperative mode. The tilt switching button 41 is an example of a "tilt switching operator".

The touch-screen display 4 displays a tilt stop button 42 on the touch panel 4*a*. The tilt stop button 42 receives an operation to stop tilting up and tilting down of the auxiliary propulsion device body 2*a* during tilt-up and tilt-down operations. When the tilt stop button 42 is pushed during tilting up (tilting down), the tilting up (tilting down) of the auxiliary propulsion device body 2*a* is forcibly stopped. The tilt stop button 42 is an example of a "tilt stop operator".

Figure 7:
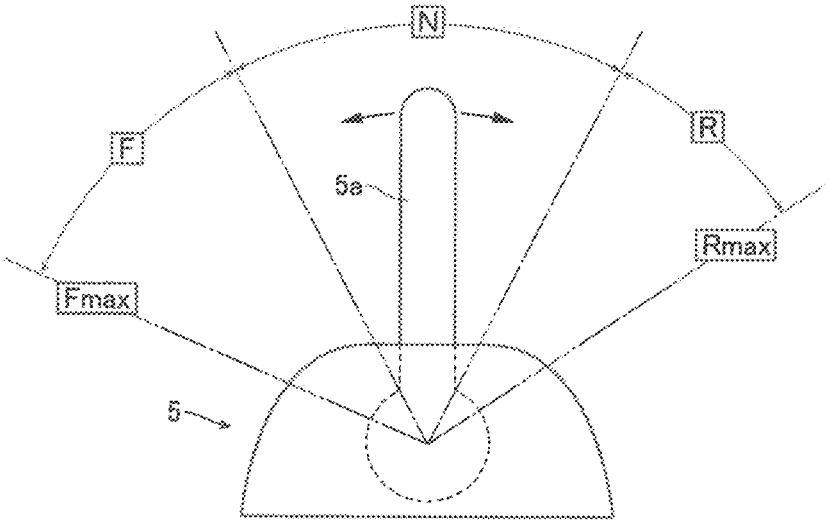
FIG. 7 is a diagram showing a remote control lever of a marine propulsion system according to a preferred embodiment of the present invention.

The remote control lever 5 shown in FIGS. 1 and 7 is switchable between a neutral state in which the main propeller 10 is stopped, a forward movement state in which the main propeller 10 generates a forward thrust, and a reverse movement state in which the main propeller 10 generates a reverse thrust. The remote control lever 5 includes a columnar lever 5*a* extending upward.

Specifically, the remote control lever 5 puts the main propulsion device 1 into the neutral state when the lever 5*a* extends vertically (the tilt angle is 0 degrees). The remote control lever 5 switches the main propulsion device 1 from the neutral state to the forward movement state when the lever 5*a* is tilted forward by a predetermined angle. The remote control lever 5 increases the forward thrust of the main propeller 10 of the main propulsion device 1 when the lever 5*a* is further tilted forward.

The remote control lever 5 switches the main propulsion device 1 from the neutral state to the reverse movement state when the lever 5*a* is tilted rearward by a predetermined angle. The remote control lever 5 increases the reverse thrust of the main propeller 10 of the main propulsion device 1 when the lever 5*a* is further tilted rearward.

The controller 6 shown in FIG. 1 performs a control to automatically tilt up the auxiliary propulsion device body 2*a* and a control to automatically tilt down the auxiliary propulsion device body 2*a* in the automatic tilt-up mode.

For example, the controller 6 performs a control to tilt up the auxiliary propulsion device body 2*a* based on the joystick mode being switched from the on-state to the off-state by the joystick button 30 while the auxiliary propulsion device body 2*a* is tilted down.

The controller 6 performs a control to tilt down the auxiliary propulsion device body 2*a* based on the joystick mode being switched from the off-state to the on-state by the joystick button 30 while the auxiliary propulsion device body 2*a* is tilted up.

The controller 6 performs a control to tilt up the auxiliary propulsion device body 2*a* based on the STAYPOINT™ mode being switched from the on-state to the off-state by the STAYPOINT™ button 31*a* while the auxiliary propulsion device body 2*a* is tilted down. The controller 6 performs a control to tilt up the auxiliary propulsion device body 2*a* based on the FISHPOINT™ mode being switched from the on-state to the off-state by the FISHPOINT™ button 31*b* while the auxiliary propulsion device body 2*a* is tilted down. The controller 6 performs a control to tilt up the auxiliary propulsion device body 2*a* based on the drift mode being switched from the on-state to the off-state by the drift button 31*c* while the auxiliary propulsion device body 2*a* is tilted down.

The controller 6 performs a control to tilt down the auxiliary propulsion device body 2*a* based on the STAYPOINT™ mode being switched from the off-state to the on-state by the STAYPOINT™ button 31*a* while the auxiliary propulsion device body 2*a* is tilted up. The controller 6 performs a control to tilt down the auxiliary propulsion device body 2*a* based on the FISHPOINT™ mode being switched from the off-state to the on-state by the FISHPOINT™ button 31*b* while the auxiliary propulsion device body 2*a* is tilted up. The controller 6 performs a control to tilt down the auxiliary propulsion device body 2*a* based on the drift mode being switched from the off-state to the on-state by the drift button 31*c* while the auxiliary propulsion device body 2*a* is tilted up.

The controller 6 maintains the tilted-up state of the auxiliary propulsion device body 2*a* when the neutral state is switched to the forward movement state by the remote control lever 5 while the auxiliary propulsion device body 2*a* is tilted up. That is, even when the remote control lever 5 is operated while the auxiliary propulsion device body 2*a* is already tilted up, the auxiliary propulsion device body 2*a* is not tilted up.

The notifier 7 notifies the user that the tilt-up operation is in progress or that the tilt-down operation is in progress in the automatic tilt-up mode. For example, the notifier 7 notifies the user that the tilt-up operation of the auxiliary propulsion device body 2*a* is in progress when the neutral state is switched to the forward movement state by the remote control lever 5. The notifier 7 includes a buzzer that emits a sound.

According to the various preferred embodiments of the present invention described above, the following advantageous effects are achieved.

According to a preferred embodiment of the present invention, the auxiliary propulsion device 2 attached to the stern 101*b* on one side of the centerline of the hull 101 in the right-left direction is operable to tilt up the auxiliary propulsion device body 2*a* when the main propulsion device 1 is switched from the neutral state to the forward movement state by the remote control lever 5 while the auxiliary propulsion device body 2*a* is tilted down. Accordingly, the auxiliary propulsion device body 2*a* is tilted up when the main propulsion device 1 moves the hull 101 forward, and thus the action of a resistance on one side of the centerline of the hull 101 in the right-left direction is reduced or prevented. Furthermore, an operation on the remote control lever 5 is used as a trigger to automatically tilt up the auxiliary propulsion device body 2*a*, and thus it is not necessary to perform a dedicated operation to tilt up the auxiliary propulsion device body 2*a*. Therefore, a decrease in the direction maintenance performance of the hull 101 due to the auxiliary propulsion device 2 attached to the stern 101*b* on one side of the centerline of the hull 101 in the right-left direction is reduced or prevented when the main propulsion device 1 moves the hull 101 forward, and the operability is improved when the main propulsion device 1 moves the hull 101 forward.

According to a preferred embodiment of the present invention, the marine propulsion system 102 includes the joystick 3 to receive an operation to move the hull 101, a joystick button 30 to receive an operation to switch the on-state and the off-state of the joystick mode in which the joystick 3 receives an operation to move the hull 101, and the controller 6 provided in the hull 101 and configured or programmed to perform a control to tilt up the auxiliary propulsion device body 2*a* based on the joystick mode being switched from the on-state to the off-state by the joystick button 30 while the auxiliary propulsion device body 2*a* is tilted down. Accordingly, switching of the joystick mode from the on-state to the off-state is used as a trigger to automatically tilt up the auxiliary propulsion device body 2*a*, and thus when the main propulsion device 1 propels the hull 101 thereafter, the main propulsion device 1 starts to propel the hull 101 while the auxiliary propulsion device body 2*a* is tilted up. That is, the auxiliary propulsion device body 2*a* is already tilted up when the remote control lever 5 is operated, and thus the main propulsion device 1 more smoothly starts to propel the hull 101.

According to a preferred embodiment of the present invention, the controller 6 is configured or programmed to perform a control to tilt down the auxiliary propulsion device body 2*a* based on the joystick mode being switched from the off-state to the on-state by the joystick button 30. Accordingly, switching of the joystick mode from the off-state to the on-state by the joystick button 30 is used as a trigger to automatically tilt down the auxiliary propulsion device body 2*a*, and thus it is not necessary to perform a dedicated operation to tilt down the auxiliary propulsion device body 2*a*. Therefore, the operability at the start of the joystick mode in which the auxiliary propulsion device 2 is also used is improved.

According to a preferred embodiment of the present invention, the marine propulsion system 102 further includes the STAYPOINT™ button 31*a* (or the FISHPOINT™ button 31*b* or the drift button 31*c*) to receive an operation to switch the on-state and the off-state of the predetermined automatic operation mode in which the main propulsion device 1 and the auxiliary propulsion device 2 are automatically driven to move the hull 101 or maintain the position of the hull 101, and the controller 6 is configured or programmed to perform a control to tilt up the auxiliary propulsion device body 2*a* based on the predetermined automatic operation mode being switched from the on-state to the off-state by the STAYPOINT™ button 31*a* (or the FISHPOINT™ button 31*b* or the drift button 31*c*) while the auxiliary propulsion device body 2*a* is tilted down. Accordingly, switching of the predetermined automatic operation mode from the on-state to the off-state by the STAYPOINT™ button 31*a* (or the FISHPOINT™ button 31*b* or the drift button 31*c*) is used as a trigger to automatically tilt up the auxiliary propulsion device body 2*a*, and thus when the main propulsion device 1 propels the hull 101 thereafter, the main propulsion device 1 starts to propel the hull 101 while the auxiliary propulsion device body 2*a* is tilted up. That is, the auxiliary propulsion device body 2*a* is already tilted up when the remote control lever 5 is operated, and thus the main propulsion device 1 more smoothly starts to propel the hull 101.

According to a preferred embodiment of the present invention, the controller 6 is configured or programmed to perform a control to tilt down the auxiliary propulsion device body 2*a* based on the predetermined automatic operation mode being switched from the off-state to the on-state by the STAYPOINT™ button 31*a* (or the FISHPOINT™ button 31*b* or the drift button 31*c*). Accordingly, switching of the predetermined automatic operation mode from the off-state to the on-state by the STAYPOINT™ button 31*a* (or the FISHPOINT™ button 31*b* or the drift button 31*c*) is used as a trigger to automatically tilt down the auxiliary propulsion device body 2*a*, and thus it is not necessary to perform a dedicated operation to tilt down the auxiliary propulsion device body 2*a*. Therefore, the operability at the start of the automatic operation mode in which the auxiliary propulsion device 2 is also used is improved.

According to a preferred embodiment of the present invention, the main propulsion device 1 and the auxiliary propulsion device 2 are operable to not drive the main propeller 10 and the auxiliary propeller 20 during the tilt-down operation of the auxiliary propulsion device body 2*a*. Accordingly, driving the main propeller 10 and the auxiliary propeller 20 during the tilt-down operation to generate a thrust in a direction different from a desired direction is reduced or prevented.

According to a preferred embodiment of the present invention, the marine propulsion system 102 further includes the angle setting button 40 to receive an operation to set the tilt angle of the auxiliary propulsion device body 2*a* at the time of completion of tilting down of the auxiliary propulsion device body 2*a*. Accordingly, the auxiliary propulsion device body 2*a* is automatically located at the set angle at the time of completion of tilting down, and thus the user does not need to adjust the angle for each tilting down, and the operability is further improved when the main propulsion device 1 propels the hull 101.

According to a preferred embodiment of the present invention, the controller 6 is configured or programmed to maintain the tilted-up state of the auxiliary propulsion device body 2*a* when the neutral state is switched to the forward movement state by the remote control lever 5 while the auxiliary propulsion device body 2*a* is tilted up. Accordingly, when the neutral state is switched to the forward movement state by the remote control lever 5, the state is maintained when the auxiliary propulsion device body 2*a* is already tilted up.

According to a preferred embodiment of the present invention, the auxiliary propulsion device 2 is operable to tilt up the auxiliary propulsion device body 2*a* when the neutral state is switched to the reverse movement state by the remote control lever 5 while the auxiliary propulsion device body 2*a* is tilted down. Accordingly, a decrease in the direction maintenance performance of the hull 101 due to the auxiliary propulsion device 2 attached to the stern 101*b* on one side of the centerline of the hull 101 in the right-left direction is reduced or prevented not only when the main propulsion device 1 moves the hull 101 forward but also when the main propulsion device 1 moves the hull 101 rearward. In addition, the operability is improved when the main propulsion device 1 moves the hull 101 rearward.

According to a preferred embodiment of the present invention, the marine propulsion system 102 further includes the tilt switching button 41 to receive an operation to switch between the automatic tilt-up mode in which the auxiliary propulsion device body 2*a* is tilted up when the neutral state is switched to the forward movement state by the remote control lever 5 and the tilt-up inoperative mode in which, when the neutral state is switched to the forward movement state by the remote control lever 5, the auxiliary propulsion device body 2*a* is not tilted up and the tilted-down state of the auxiliary propulsion device 2 is maintained. Accordingly, in consideration of a case in which the user does not want the tilting up to be performed automatically, for example, the tilt switching button 41 is used to switch between the automatic tilt-up mode and the tilt-up inoperative mode.

According to a preferred embodiment of the present invention, the marine propulsion system 102 further includes the tilt stop button 42 to receive an operation to stop tilting up and tilting down of the auxiliary propulsion device body 2*a* during tilt-up and tilt-down operations. Accordingly, during the tilt-up and tilt-down operations that are automatically performed, the tilting up and the tilting down are stopped by the user's will depending on the situation.

According to a preferred embodiment of the present invention, the marine propulsion system 102 further includes the notifier 7 to notify the user that the tilt-up operation of the auxiliary propulsion device body 2*a* is in progress when the neutral state is switched to the forward movement state by the remote control lever 5. Accordingly, the notifier 7 makes the user aware of tilting up when the tilting up is performed unintentionally. Furthermore, the user is made aware that the auxiliary propulsion device body 2*a* is in operation.

According to a preferred embodiment of the present invention, the main propulsion device 1 is an engine outboard motor including the engine 12 to drive the main propeller 10, and the auxiliary propulsion device 2 is an electric outboard motor including the electric motor 23 to drive the auxiliary propeller 20. Accordingly, environmental burdens such as carbon dioxide emission associated with driving of the engine outboard motor are reduced. Furthermore, a decrease in the direction maintenance performance of the hull 101 including the engine outboard motor and the electric outboard motor is reduced or prevented when the main propulsion device 1 propels the hull 101, and the operability is improved when the main propulsion device 1 propels the hull 101.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the marine propulsion system preferably includes only one main propulsion device in preferred embodiments described above, the present invention is not restricted to this. In a preferred embodiment of the present invention, the marine propulsion system may alternatively include a plurality of main propulsion devices.

While the auxiliary propulsion device body is preferably tilted up by the tilt device when the main propulsion device is switched from the neutral state to the forward movement state by the remote control lever in preferred embodiments described above, the present invention is not restricted to this. In a preferred embodiment of the present invention, the auxiliary propulsion device body may alternatively be tilted up by the tilt device when a low speed state in which the hull is propelled at less than a predetermined speed is switched to a high speed state in which the hull is propelled at the predetermined speed or higher by the remote control lever. Specifically, in the marine propulsion system, the remote control lever changes the magnitudes of the thrusts of the main propeller (main thruster) and the auxiliary propeller (auxiliary thruster). When the remote control lever is tilted to switch the neutral state to the forward movement state, the auxiliary propeller is first driven. When the remote control lever is further tilted to propel the hull at the predetermined speed (when the hull reaches the predetermined speed or higher), the auxiliary propeller stops, and the main propeller starts to be driven. At the timing at which the main propeller starts to be driven, the auxiliary propulsion device body is tilted up.

With the structure as described above, the auxiliary propulsion device body is tilted up when the marine vessel speed is increased, and thus the action of a resistance on one side of the centerline of the hull in the right-left direction is reduced or prevented. Furthermore, an operation on the remote control lever is used as a trigger to automatically tilt up the auxiliary propulsion device body, and thus it is not necessary to perform a dedicated operation to tilt up the auxiliary propulsion device body. Therefore, a decrease in the direction maintenance performance of the hull due to the auxiliary propulsion device attached to the stern on one side of the centerline of the hull in the right-left direction is reduced or prevented when the marine vessel speed is increased (when the main propulsion device propels the hull), and the operability is improved when the marine vessel speed is increased (when the main propulsion device propels the hull).

While the marine propulsion system preferably includes only one auxiliary propulsion device in preferred embodiments described above, the present invention is not restricted to this. In a preferred embodiment of the present invention, the marine propulsion system may alternatively include a plurality of auxiliary propulsion devices.

While the main thruster of the main propulsion device is preferably the main propeller in preferred embodiments described above, the present invention is not restricted to this. In a preferred embodiment of the present invention, the main thruster of the main propulsion device may alternatively be a jet that generates a thrust by jetting water.

While the auxiliary thruster of the auxiliary propulsion device is preferably the auxiliary propeller in preferred embodiments described above, the present invention is not restricted to this. In a preferred embodiment of the present invention, the auxiliary thruster of the auxiliary propulsion device may alternatively be a jet that generates a thrust by jetting water.

While the main propulsion device is preferably an engine outboard motor in preferred embodiments described above, the present invention is not restricted to this. In a preferred embodiment of the present invention, the main propulsion device may alternatively be an electric outboard motor. Furthermore, the main propulsion device may alternatively be an inboard motor or an inboard-outboard motor, for example, instead of an outboard motor.

While the auxiliary propulsion device is preferably an electric outboard motor in preferred embodiments described above, the present invention is not restricted to this. In a preferred embodiment of the present invention, the auxiliary propulsion device may alternatively be an engine outboard motor. Furthermore, the auxiliary propulsion device may alternatively be an inboard motor or an inboard-outboard motor, for example, instead of an outboard motor.

While the controller preferably tilts up the auxiliary propulsion device body based on the joystick mode being switched from the on-state to the off-state in preferred embodiments described above, the present invention is not restricted to this. In a preferred embodiment of the present invention, when the joystick mode is switched from the on-state to the off-state, the tilted-down state of the auxiliary propulsion device may alternatively be maintained without tilting up the auxiliary propulsion device body.

While the controller preferably tilts up the auxiliary propulsion device body based on the STAYPOINT™ mode, the FISHPOINT™ mode, or the drift mode (automatic operation mode) being switched from the on-state to the off-state in preferred embodiments described above, the present invention is not restricted to this. In a preferred embodiment of the present invention, when the STAYPOINT™ mode, the FISHPOINT™ mode, or the drift mode (automatic operation mode) is switched from the on-state to the off-state, the tilted-down state of the auxiliary propulsion device may alternatively be maintained without tilting up the auxiliary propulsion device body.

While the notifier preferably includes a buzzer in preferred embodiments described above, the present invention is not restricted to this. In a preferred embodiment of the present invention, the notifier may alternatively include a lamp or a display, for example.

While the angle setting button (angle setting operator) is preferably displayed on the touch-screen display in preferred embodiments described above, the present invention is not restricted to this. In a preferred embodiment of the present invention, the angle setting button may alternatively be provided as a mechanical button on a panel operator, for example.

While the tilt switching button (tilt switching operator) is preferably displayed on the touch-screen display in preferred embodiments described above, the present invention is not restricted to this. In a preferred embodiment of the present invention, the tilt switching button may alternatively be provided as a mechanical button on a panel operator, for example.

While the tilt stop button (tilt stop operator) is preferably displayed on the touch-screen display in preferred embodiments described above, the present invention is not restricted to this. In a preferred embodiment of the present invention, the tilt stop button may alternatively be provided as a mechanical button on a panel operator, for example.

While the automatic operation mode preferably includes the STAYPOINT™ mode, the FISHPOINT™ mode, and the drift mode in preferred embodiments described above, the present invention is not restricted to this. In a preferred embodiment of the present invention, the automatic operation mode may alternatively include other modes such as a heading hold mode and a course hold mode.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a main propulsion device to be attached to a stern of a hull on a centerline of the hull in a right-left direction and including a main thruster to generate a thrust;

an auxiliary propulsion device to be attached to the stern on one side of the centerline of the hull in the right-left direction, including an auxiliary thruster to generate a thrust, and having a maximum output smaller than a maximum output of the main propulsion device; and a remote control lever to switch between a neutral state in which the main thruster is stopped, a forward movement state in which the main thruster generates a forward thrust, and a reverse movement state in which the main thruster generates a reverse thrust; wherein the auxiliary propulsion device further includes a tilt device to tilt up and tilt down an auxiliary propulsion device body, and is operable to tilt up the auxiliary propulsion device body with the tilt device when the main propulsion device is switched from the neutral state to the forward movement state by the remote control lever while the auxiliary propulsion device body is tilted down.

2. The marine propulsion system according to claim 1, further comprising:

a joystick to receive an operation to move the hull;

a joystick mode operator to receive an operation to switch between an on-state and an off-state of a joystick mode in which the joystick receives the operation to move the hull; and a controller provided in the hull and configured or programmed to perform a control to tilt up the auxiliary propulsion device body based on the joystick mode being switched from the on-state to the off-state by the joystick mode operator while the auxiliary propulsion device body is tilted down.

3. The marine propulsion system according to claim 2, wherein the controller is configured or programmed to perform a control to tilt down the auxiliary propulsion device body based on the joystick mode being switched from the off-state to the on-state by the joystick mode operator.

4. The marine propulsion system according to claim 2, further comprising:

an automatic operation mode operator to receive an operation to switch between an on-state and an off-state of a predetermined automatic operation mode in which the main propulsion device and the auxiliary propulsion device are automatically driven to move the hull or maintain a position of the hull; wherein the controller is configured or programmed to perform a control to tilt up the auxiliary propulsion device body based on the predetermined automatic operation mode being switched from the on-state to the off-state by the automatic operation mode operator while the auxiliary propulsion device body is tilted down.

5. The marine propulsion system according to claim 4, wherein the controller is configured or programmed to perform a control to tilt down the auxiliary propulsion device body based on the predetermined automatic operation mode being switched from the off-state to the on-state by the automatic operation mode operator.

6. The marine propulsion system according to claim 3, wherein the main propulsion device and the auxiliary propulsion device are operable to not drive the main thruster and the auxiliary thruster during a tilt-down operation of the auxiliary propulsion device body.

7. The marine propulsion system according to claim 3, further comprising:

an angle setting operator to receive an operation to set a tilt angle of the auxiliary propulsion device body at a time of completion of tilting down of the auxiliary propulsion device body.

8. The marine propulsion system according to claim 2, wherein the controller is configured or programmed to maintain a tilted-up state of the auxiliary propulsion device body when the neutral state is switched to the forward movement state by the remote control lever while the auxiliary propulsion device body is tilted up.

9. The marine propulsion system according to claim 1, wherein the auxiliary propulsion device is operable to tilt up the auxiliary propulsion device body when the neutral state is switched to the reverse movement state by the remote control lever while the auxiliary propulsion device body is tilted down.

10. The marine propulsion system according to claim 1, further comprising:

a tilt switching operator to receive an operation to switch between an automatic tilt-up mode in which the auxiliary propulsion device body is tilted up when the neutral state is switched to the forward movement state by the remote control lever, and a tilt-up inoperative mode in which, when the neutral state is switched to the forward movement state by the remote control lever, the auxiliary propulsion device body is not tilted up and a tilted-down state of the auxiliary propulsion device is maintained.

11. The marine propulsion system according to claim 1, further comprising:

a tilt stop operator to receive an operation to stop tilting up and tilting down of the auxiliary propulsion device body during tilt-up and tilt-down operations.

12. The marine propulsion system according to claim 1, further comprising:

a notifier to notify a user that at least a tilt-up operation of the auxiliary propulsion device body is in progress when the neutral state is switched to the forward movement state by the remote control lever.

13. The marine propulsion system according to claim 1, wherein the main propulsion device is an engine outboard motor including an engine to drive a main propeller corresponding to the main thruster; and the auxiliary propulsion device is an electric outboard motor including an electric motor to drive an auxiliary propeller corresponding to the auxiliary thruster.

14. A marine propulsion system comprising:

a main propulsion device to be attached to a stern of a hull on a centerline of the hull in a right-left direction and including a main thruster to generate a thrust;

an auxiliary propulsion device to be attached to the stern on one side of the centerline of the hull in the right-left direction, including an auxiliary thruster to generate a thrust, and having a maximum output smaller than a maximum output of the main propulsion device; and a remote control lever to change magnitudes of thrusts of the main thruster and the auxiliary thruster; wherein the auxiliary propulsion device further includes a tilt device to tilt up and tilt down an auxiliary propulsion device body, and is operable to tilt up the auxiliary propulsion device body with the tilt device when a low speed state in which the hull is propelled at less than a predetermined speed is switched to a high speed state in which the hull is propelled at the predetermined speed or higher by the remote control lever while the auxiliary propulsion device body is tilted down.

15. A marine vessel comprising:

a hull; and a marine propulsion system provided on or in the hull; wherein the marine propulsion system includes:

a main propulsion device to be attached to a stern of a hull on a centerline of the hull in a right-left direction and including a main thruster to generate a thrust;

an auxiliary propulsion device to be attached to the stern on one side of the centerline of the hull in the right-left direction, including an auxiliary thruster to generate a thrust, and having a maximum output smaller than a maximum output of the main propulsion device; and a remote control lever to switch between a neutral state in which the main thruster is stopped, a forward movement state in which the main thruster generates a forward thrust, and a reverse movement state in which the main thruster generates a reverse thrust; wherein the auxiliary propulsion device further includes a tilt device to tilt up and tilt down an auxiliary propulsion device body, and is operable to tilt up the auxiliary propulsion device body with the tilt device when the main propulsion device is switched from the neutral state to the forward movement state by the remote control lever while the auxiliary propulsion device body is tilted down.

16. The marine vessel according to claim 15, wherein the marine propulsion system further includes:

a joystick to receive an operation to move the hull;

a joystick mode operator to receive an operation to switch between an on-state and an off-state of a joystick mode in which the joystick receives the operation to move the hull; and a controller provided in the hull and configured or programmed to perform a control to tilt up the auxiliary propulsion device body based on the joystick mode being switched from the on-state to the off-state by the joystick mode operator while the auxiliary propulsion device body is tilted down.

17. The marine vessel according to claim 16, wherein the controller is configured or programmed to perform a control to tilt down the auxiliary propulsion device body based on the joystick mode being switched from the off-state to the on-state by the joystick mode operator.

18. The marine vessel according to claim 16, wherein the marine propulsion system further includes:

an automatic operation mode operator to receive an operation to switch between an on-state and an off-state of a predetermined automatic operation mode in which the main propulsion device and the auxiliary propulsion device are automatically driven to move the hull or maintain a position of the hull; and the controller is configured or programmed to perform a control to tilt up the auxiliary propulsion device body based on the predetermined automatic operation mode being switched from the on-state to the off-state by the automatic operation mode operator while the auxiliary propulsion device body is tilted down.

19. The marine vessel according to claim 18, wherein the controller is configured or programmed to perform a control to tilt down the auxiliary propulsion device body based on the predetermined automatic operation mode being switched from the off-state to the on-state by the automatic operation mode operator.

20. The marine vessel according to claim 17, wherein the main propulsion device and the auxiliary propulsion device are operable to not drive the main thruster and the auxiliary thruster during a tilt-down operation of the auxiliary propulsion device body.

* * * * *